US012048986B2

(12) United States Patent
Song

(10) Patent No.: US 12,048,986 B2
(45) Date of Patent: Jul. 30, 2024

(54) MANUFACTURING METHOD FOR GRINDING WHEEL AND GRINDING METHOD FOR GRINDING WORKPIECE USING GRINDING WHEEL

(71) Applicant: GUILIN CHAMPION UNION DIAMOND CO., LTD., Guangxi (CN)

(72) Inventor: Jingxin Song, Guangxi (CN)

(73) Assignee: GUILIN CHAMPION UNION DIAMOND CO., LTD., Guangxi (CN)

( * ) Notice: Subject to any disclaimer, the term of this patent is extended or adjusted under 35 U.S.C. 154(b) by 578 days.

(21) Appl. No.: 17/363,012

(22) Filed: Jun. 30, 2021

(65) Prior Publication Data

US 2021/0323123 A1 Oct. 21, 2021

Related U.S. Application Data

(63) Continuation-in-part of application No. 14/332,348, filed on Jul. 15, 2014, now abandoned, which is a (Continued)

(30) Foreign Application Priority Data

Jan. 17, 2012 (CN) ..... 201210013303.8
Jan. 17, 2012 (CN) ..... 201210013305.7
Jan. 17, 2012 (CN) ..... 201210013504.8

(51) Int. Cl.
*B24D 5/06* (2006.01)
*B24B 57/02* (2006.01)

(52) U.S. Cl.
CPC ..... *B24D 5/06* (2013.01); *B24B 57/02* (2013.01)

(58) Field of Classification Search
CPC ..... B24D 5/06; B24B 57/02; B24B 9/002; B24B 9/005; B24B 9/02; B24B 9/04; (Continued)

(56) References Cited

U.S. PATENT DOCUMENTS 3,282,263 A * 11/1966 Christensen ..... B28D 1/122 451/449
3,641,718 A * 2/1972 Ferchland ..... B24D 5/12 451/544

(Continued)

FOREIGN PATENT DOCUMENTS

CA 2366868 A1 * 8/2000 ..... B24D 5/066

*Primary Examiner* — Joel D Crandall
(74) *Attorney, Agent, or Firm* — JCIPRNET

(57) ABSTRACT

A manufacturing method comprises the following steps. A shape of a first cross-section of a to-be-ground portion of a workpiece to be ground by a grinding wheel is obtained. The grinding wheel is manufactured according the shape of the first cross-section. When the to-be-ground portion is contacted and to be ground by the grinding surface, a first intersection line formed by the first cross-section and one of reference planes has a first length, second intersection lines formed by the grinding surface and one of the reference planes have second lengths, and all ratios between the first length of the first intersection line and a sum of the second lengths of the second intersection lines formed by the same reference plane are equal to each other. The reference planes are perpendicular to the rotation axis of the grinding wheel.

10 Claims, 17 Drawing Sheets

Related U.S. Application Data continuation-in-part of application No. PCT/CN2013/070506, filed on Jan. 16, 2013.

(58) Field of Classification Search
CPC .. B24B 9/06; B24B 9/065; B24B 9/08; B24B 9/10; B24B 9/102; B24B 9/107
See application file for complete search history.

(56) References Cited

U.S. PATENT DOCUMENTS

| | | | | |
|---|---|---|---|---|
| 5,423,717 | A * | 6/1995 | Boaz | B24B 9/10 451/449 |
| 5,846,125 | A * | 12/1998 | Robichon | B24D 5/10 451/550 |
| 6,739,960 | B2 * | 5/2004 | Sauer | B24D 5/10 451/449 |
| 2005/0277377 | A1 * | 12/2005 | Nomoto | B24B 9/06 451/541 |

* cited by examiner

MANUFACTURING METHOD FOR GRINDING WHEEL AND GRINDING METHOD FOR GRINDING WORKPIECE USING GRINDING WHEEL

CROSS-REFERENCE TO RELATED APPLICATIONS

This is a continuation-in-part application of U.S. patent application Ser. No. 14/332,348, filed on Jul. 15, 2014, now pending. The prior U.S. patent application Ser. No. 14/332,348 is a continuation-in-part application of International Patent Application No. PCT/CN2013/070506, filed on Jan. 16, 2013, which claims the priority benefit of Chinese Patent Application No. 201210013504.8 filed Jan. 17, 2012, Chinese Patent Application No. 201210013303.8 filed Jan. 17, 2012, and Chinese Patent Application No. 201210013305.7 filed Jan. 17, 2012. The entirety of each of the above-mentioned patent applications is hereby incorporated by reference herein and made a part of this specification.

BACKGROUND

Technical Field

The invention relates to a grinding tool, and more particularly to an anti-deforming and highly efficient grinding wheel.

Description of Related Art

Grinding of metals or non-metal materials is finished by a grinding wheel. A grinding wheel having a planar grinding surface (or a planar moving track) is used for plane processing and a forming wheel having non-planar (special-shaped) grinding surface is used for special-shaped edge grinding.

Two important indicators, i.e., the grinding efficiency and the deformation of the grinding surface, are used to assess the performance of the grinding wheel.

1. Grinding Efficiency

A large amount of grinding heat and chips are produced in the grinding process of the grinding wheel, so that the grinding wheel needs to be cooled during the processing (planar grinding and special-shaped grinding). The cooling method includes providing cooling water by a cooling mechanism of a grinding machine and enabling the cooling water to act on the grinding surface. The cooling water is capable of cooling the processing surface of the workpiece as well as removing a majority of the chips by washing. The discharge rate and the discharge amount of the chips directly affect the quality and efficiency of the processing.

The grinding machine is divided into an outer cooling grinding machine and an inner cooling grinding machine according to the difference in cooling modes.

1) The cooling mechanism of the outer cooling grinding machine has a simple structure and mainly includes a cooling pipe connected to a pumping source. The cooling pipe is installed on a working table. A coolant ejected from the cooling pipe directly acts on the processing surface of the workpiece, however, the coolant is fast separated from the processing surface of the workpiece under the action of the centrifugal force due to the rotation of the grinding wheel. Furthermore, the working surface is tightly attached to the workpiece during the grinding, and the chips produced in the grinding form a proof layer against the coolant, so that the coolant is actually difficult to enter the working surface during processing but only functions in cooling the grinding wheel before and after the grinding.

2) The inner cooling grinding machine is provided with the grinding wheel having the inner cooling mechanism. The coolant is capable of directly acting on the working surface of the grinding. Generally, the cooling effect on the inner cooling mode is better than that of the outer cooling mode. The inner cooling grinding wheel is provided with a water inlet disposed on an axle hole of a center axle of a base corresponding to the position of a water outlet of a rotating shaft of the grinding wheel on the inner cooling grinding machine. The grinding wheel is provided with (a small number of) water channels disposed inside the base and (a small number of) water outlets on the grinding ring. The coolant is supplied by the water outlet of the rotating shaft for mounting the grinding wheel. The coolant enters the water inlet of the axle hole of the center axle of the grinding wheel via the water outlet of the rotating shaft, passes through the water channels, and acts on the working surface after being ejected out of the water outlets of the grinding ring.

Since problems including the inner cooling layout, the connection of the water outlet of the rotating shaft, the water inlet of the axle hole of the center axle, and the outlets of the grinding wheel, and the sealing of the connection are to be solved, the complicate structure of the inner cooling grinding machine is resulted, and the production costs of the inner cooling grinding machine is increased. Furthermore, only the special grinding wheel having the cooling structure rather than the common grinding wheel is applicable to the inner cooling grinding machine, thereby resulting in the increase of the comprehensive processing costs.

3) In both the common grinding wheel used in the outer cooling grinding machine and the inner cooling grinding wheel used in the inner cooling grinding machine, the grinding surfaces in the grinding wheel base on the current technology determines that the discharge thread of the chips is long and the discharge amount of the chips is limited. However, the discharge rate and the discharge amount of the chips directly affect the processing quality and efficiency. When it is difficult to totally removing the chips, the processing quality and efficiency are decreased. This is the key factor limiting the working efficiency of the grinding wheel.

2. Deformation of the Grinding Surface

The non-planar shape (special shape) of the grinding surface is corresponding to the formation requirement of the material to be processed. The final forming shape of the workpiece is generally an arc or other geometric shaped, such as regular geometric shape, or irregular geometric shape formed by straight lines, arc lines, or curved lines.

For blanks to be special-shaped edge grinded, a machining allowance is reserved. The reserved machining allowance is not particularly corresponding to the shape of the special-shaped grinding surface but in most conditions the original geometric shape of the machining allowance is relatively regular (commonly a square shape) and the material is uniform. During the processing, processing capacities at different positions in the axial direction of the special-shaped grinding surface of the grinding wheel are probably not equivalent, or even in the relation of multiple differences, however, the material of the grinding wheel is uniform. Thus, different wear degrees are resulted along with corresponding processing capacities of different axial positions of the special-shaped grinding surface of the grinding wheel, deformation of the special-shaped grinding surface, followed by abnormal use of the grinding wheel, easily occurs, thereby requiring rehabilitation or resulting in abandonment.

SUMMARY

In view of the above-described problems, the disclosure to manufacture an anti-deforming and highly efficient grinding wheel and to provide a grinding method that has enhanced anti-deforming capacity, improved effects in cooling and chip removal.

In accordance with one embodiment of the invention, there is provided a manufacturing method for a grinding wheel comprising the following steps. A shape of a first cross-section of a to-be-ground portion of a workpiece to be ground by the grinding wheel is obtained. The first cross-section and a rotation axis of the grinding wheel are on a same plane perpendicular to the horizontal. The grinding wheel is manufactured according the shape of the first cross-section of the to-be-ground portion. The grinding wheel comprises a base and a grinding ring disposed on the base. The grinding ring has a grinding surface configured to contact and grind the to-be-ground portion. Water outlets are provided at the grinding surface. The water outlets pass through the grinding ring. The water outlets each communicates with a corresponding water channel provided in the base. The water channels are connected to a water inlet. When the to-be-ground portion is ground, a first intersection line formed by the first cross-section and one of reference planes has a first length, second intersection lines formed by the grinding surface and one of the reference planes and separated by the water outlets have second lengths, ratios between the first length of the first intersection line and a sum of the second lengths of the second intersection lines formed by the same reference plane are equal to each other, the reference planes are perpendicular to the rotation axis of the grinding wheel.

In accordance with another one embodiment of the invention, there is provided a grinding method for grinding a workpiece using a grinding wheel comprising the following steps. A shape of a first cross-section of a to-be-ground portion of the workpiece is provided. The first cross-section and a rotation axis of the grinding wheel are on a same plane perpendicular to the horizontal. The grinding wheel is provided. The grinding wheel is manufactured according the shape of the first cross-section of the to-be-ground portion. The grinding wheel comprises a base and a grinding ring disposed on the base. The grinding ring has a grinding surface configured to contact and grind the to-be-ground portion. Water outlets are provided at the grinding surface. The water outlets pass through the grinding ring. The water outlets each communicates with a corresponding water channel provided in the base. The water channels are connected to a water inlet. The workpiece is ground to remove the to-be-ground portion by using the grinding wheel. When the to-be-ground portion is ground, a first intersection line formed by the first cross-section and one of reference planes has a first length, second intersection lines formed by the grinding surface and one of the reference planes and separated by the water outlets have second lengths, ratios between the first length of the first intersection line and a sum of the second lengths of the second intersection lines formed by the same reference plane are equal to each other, the reference planes are perpendicular to the rotation axis of the grinding wheel.

DESCRIPTION OF THE EMBODIMENTS

Figure 1:
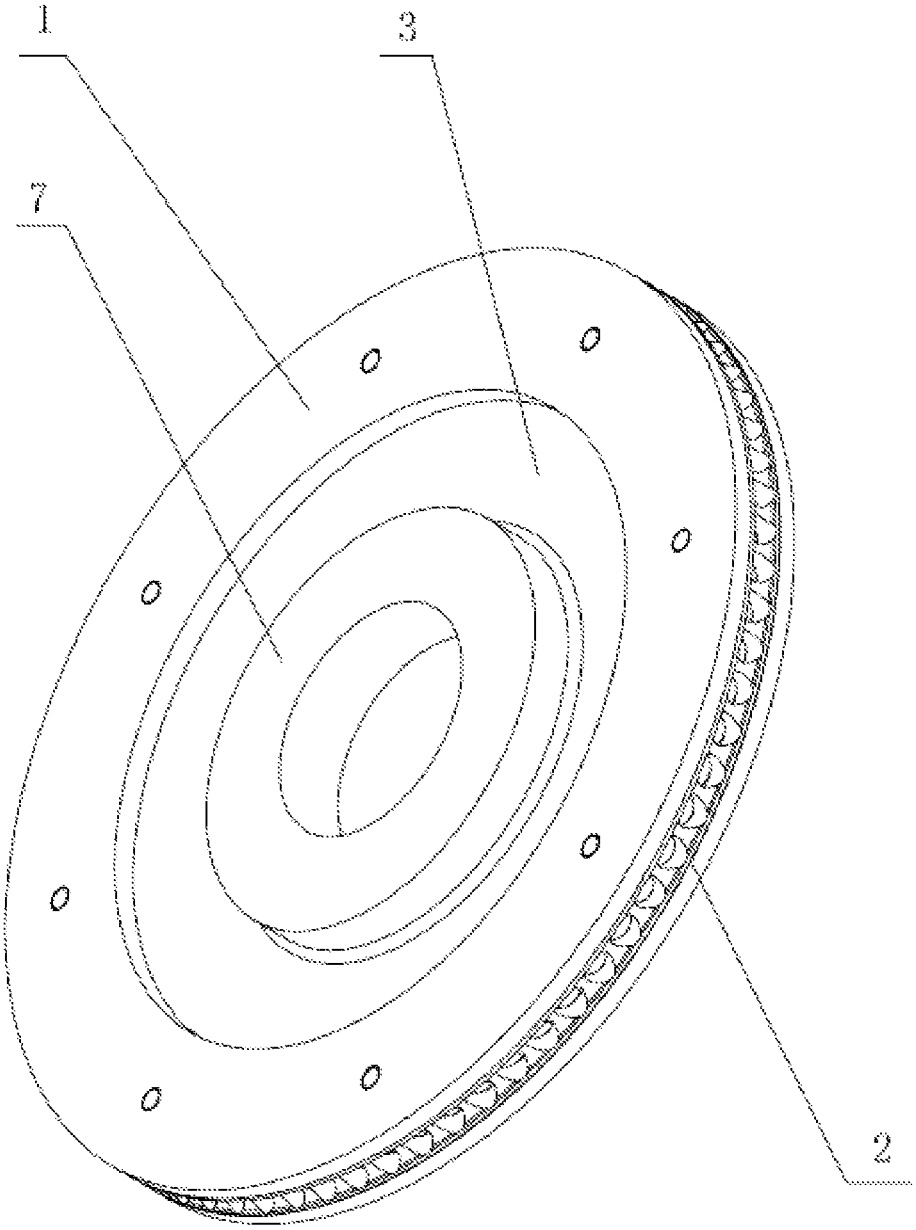
FIG. 1 is a stereogram of an embodiment of a grinding wheel of the invention.

The water outlets (the non-entity processing region) are capable of cooling the grinding wheel and the workpiece as well as simultaneously introducing chips produced in the grinding into the water outlets for storage. When the outlets stored with chips separates from a working surface of the grinding along with the rotation of the grinding wheel, the chips therein are smoothly discharged under the action of the centrifugal force and the water flow (cooling water is capable of entering the water inlet of the base and being ejected from the water outlets via the corresponding water channels), thereby effectively and timely removing the chips.

For high qualified grinding wheel, to process workpiece that has high requirements on the machining precision and flatness, the number of the water outlets is preferably larger than zero in the range of between one and three times the contact line length of the grinding, that is, at least a small part or even a very small part of one water outlet is within the range of the contact line length of the grinding. Thus, it is ensured that in every moment of the processing process, the cooling water always acts on the grinding surface for timely cooling within the range of the contact line length between the grinding wheel and the workpiece, thereby realizing the true sense of cooling in the whole process and avoiding abnormal wear resulted from local excessive high temperature. Furthermore, the water outlets are capable of timely introducing the chips produced in the grinding into the water outlets for storage and timely and effectively discharging the chips, so that the grinding capability of the abrasive grains of the grinding wheel is ensured.

In the entity processing region (referring to portions contacting with the workpiece during the grinding) of the grinding ring, different axial positions of the grinding wheel are allocated with corresponding total circumference lengths of the entity processing region according to the to-be-ground portion that need to be ground by the grinding wheel during the processing. In another word, the larger the to-be-ground portion of the workpiece is, the larger the corresponding total circumference length of the entity processing region is; and the smaller the to-be-ground portion of the workpiece is, the smaller the corresponding total circumference length of the entity processing region is. Thus, the depth of the to-be-ground portion is proportional to corresponding total circumference length of the entity processing region, thereby forming an equivalent shaped abrasion structure and solving or alleviating the deformation problem of special-shaped grinding wheel.

When requirement on the shape of the workpiece is not high, the range thereof is relatively wide, or the manufacturing of the grinding wheel is excessively difficult, different positions in the axial direction of the grinding wheel are allocated with corresponding total circumference lengths of the entity processing region according to the to-be-ground portion that need to be ground by the grinding wheel during the processing process. The proportional relation between the two is properly widened to be approximate proportional relation.

The more the water outlets are employed, the better the cooling effect and the chip removal effect are. However, the number of the water outlets is determined according to different conditions and in comprehensive consideration of factors, such as the production costs.

In conditions that the grinding range (the contact line length) is small and the water outlets are large and sparsely arranged, whether a large part or a small part or even a very small part of one water outlet is within one fold of the range of the contact line length, very good effect can be obtained. In conditions that the water outlets are small and intensive, the number of the water outlet within one fold of the range of the contact line during the grinding is preferably one or more than one, such as several, tens, or dozens of the water outlets. According to working experiences and experiments, the number of the water outlets is preferably no more than 30. Excessive water outlets increase the difficulty in manufacturing and decrease the intensity of the grinding ring.

For low qualified grinding wheel, if it is used to process workpiece that has not high requirements on the machining precision and the flatness, or if it is a low-speed grinding wheel, the density of the water outlets can be slightly decreased. The requirement on the arrangement of the water outlets can be widened according to requirements of grinding wheels of different qualities. It has demonstrated from repeated experiments that more than zero water outlet distributed within three or more than three times the contact line length of the grinding reaches obviously better cooling and chip removal effects than that of products in the prior art. Similarly, the number of the water outlets is preferably no more than 30.

As the number of the water outlets is designed to be enough, the material for manufacturing the grinding ring is effectively reduced, and the production costs of the grinding wheel is decreased. Theoretically, the water outlets can be designed to be any shapes, such as regular geometric shapes, or irregular geometric shapes formed by straight lines, arcs, and curves. For curved processing surface of the workpiece, the water outlets in circular or oval shape that are easily processing are adopted.

When an axial width of the water outlet is larger than a thickness of the processing surface of the workpiece, a micro-distance discontinuous grinding structure or a semi-discontinuous grinding structure is formed. The semi-discontinuous grinding structure has much smaller beating, thereby being beneficial to process those having high requirement on the edge collapse.

When the axial width of the water outlet is smaller than the thickness of the processing surface of the workpiece, the water outlets form a continuous grinding structure, edge collapse resulting from beating is eliminated, thereby satisfying machining condition that has high requirement on the edge collapse.

A plurality of arrangements of the water channels and the water inlets and connection modes therebetween can be employed to reach the inner cooling structure of the grinding wheel of the disclosure. For example, like the existing inner cooling grinding wheel, the water channels are connected to the water inlet disposed on the axle hole of the center axle of the base, the cooling water flows from a water outlet of a rotating shaft of the grinding wheel to the water inlet of the axle hole of the base, passes through the water channels and corresponding water outlets and is finally ejected on the working surface of the grinding.

The preferable arrangement of each of the water channels and the water inlet and the connection mode therebetween is changing the position of the water inlet to reach the inner cooling function on an outer cooling grinding machine. One of the methods is arranging the water inlet on the base to make the water inlet be an open mouth, introducing a coolant ejected from a cooling pipe of the outer cooling grinding machine to the open mouth of the base, and enabling the coolant to pass through the water channels and the water outlets and to act on the working surface of the grinding. Thus, the cooling in the whole processing process is ensured.

The structure of the base can be further improved, thereby simplifying the processing of the water inlet and the water channels. As an improved structure, the base comprises two base plates. The grinding ring is clamped between the two base plates. A water storage region functioning as the water channel forms between the two base plates. The water inlet is disposed on one base plate, and the center axle is disposed on the other base plate.

The water inlet is a ring-shaped mouth disposed on the base plate.

The base plate provided with the ring-shaped mouth is a ring-shaped press plate. A diameter of an inner ring of the ring-shaped press plate is larger than the center axle. The ring-shaped mouth is produced between the inner ring of the ring-shaped press plate and the center axle.

In condition that two or more than two grinding wheels arranged co-axially in parallel are used, particularly for the grinding wheel used in the outer cooling grinding machine, the water channels of the grinding wheels communicate with one another for ensuring that the coolant is supplied to each grinding wheel.

The grinding ring of the grinding wheel is a superhard abrasive. The entity processing region of the grinding ring is formed by one-step formation or by combination formation.

The technical solution is also applicable for dry grinding, in which, the cooling water is substituted by the air, and thus, the water inlet, the water channels and the water outlets are correspondingly replaced by an air inlet, air channels, and air outlets.

Compared with the prior art:

1. The grinding wheel of the disclosure is provided with enough number of water outlets based on the structure of the inner cooling grinding wheel, so that the chips produced in the grinding region are quickly discharged, the surface roughness of the processing surface and the sharpness of the grinding wheel are largely improved, thereby ensuring that the grinding wheel is capable of processing the workpiece much faster and improving the production efficiency.

2. The grinding wheel of the disclosure comprises the equivalent shaped abrasion structure, so that the anti-deformation ability of the grinding wheel is enhanced in the structure, deformation factors and malfunction factors are largely decreased, and the service life of the grinding wheel is prolonged.

3. The grinding wheel of the disclosure adopts continuous, discontinuous, or semi-discontinuous grinding modes according to the quality requirement, and combines the fast cooling mode of the inner cooling with the structure of fast chips discharge (accommodation) to largely improve the surface roughness of the processing surface and the sharpness of the grinding wheel, thereby ensure fast processing of the grinding wheel.

4. The grinding wheel of the disclosure enables a majority of the outer cooling special-shaped machining devices on the market to realize the functions of the inner cooling machining devices by hardly increasing any production costs. Thus, money invested in highly priced inner cooling machining device is saved and the economic effect is very obvious.

For further illustrating the disclosure, experiments detailing an anti-deforming and highly efficient grinding wheel are described hereinbelow combined with the drawings.

An anti-deforming and highly efficient grinding wheel comprises a base 1 and a grinding ring 2. The base 1 is assembled by a base plate 1-1 and a ring-shaped press plate 1-2.

Figure 2:
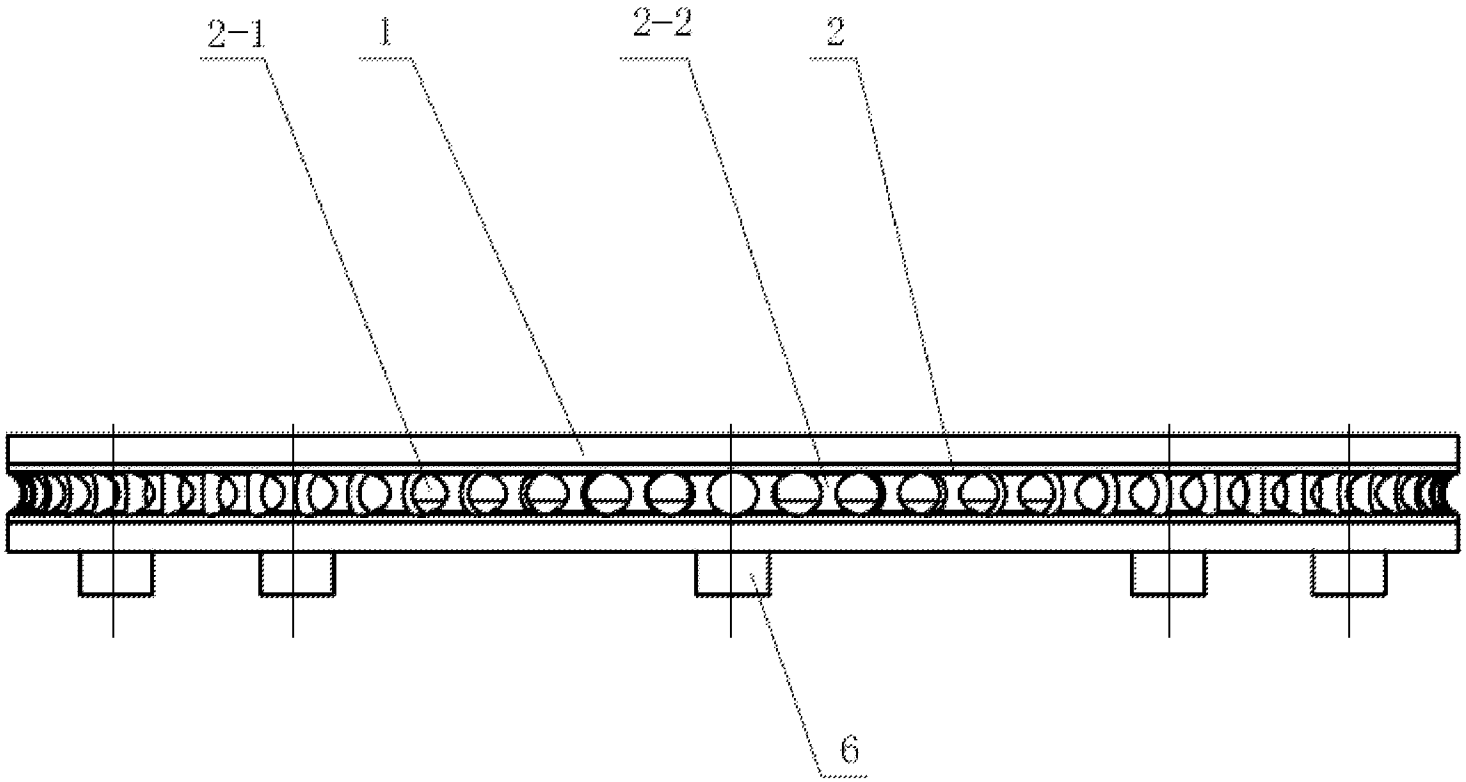
FIG. 2 is a front view of FIG. 1.
Figure 3:
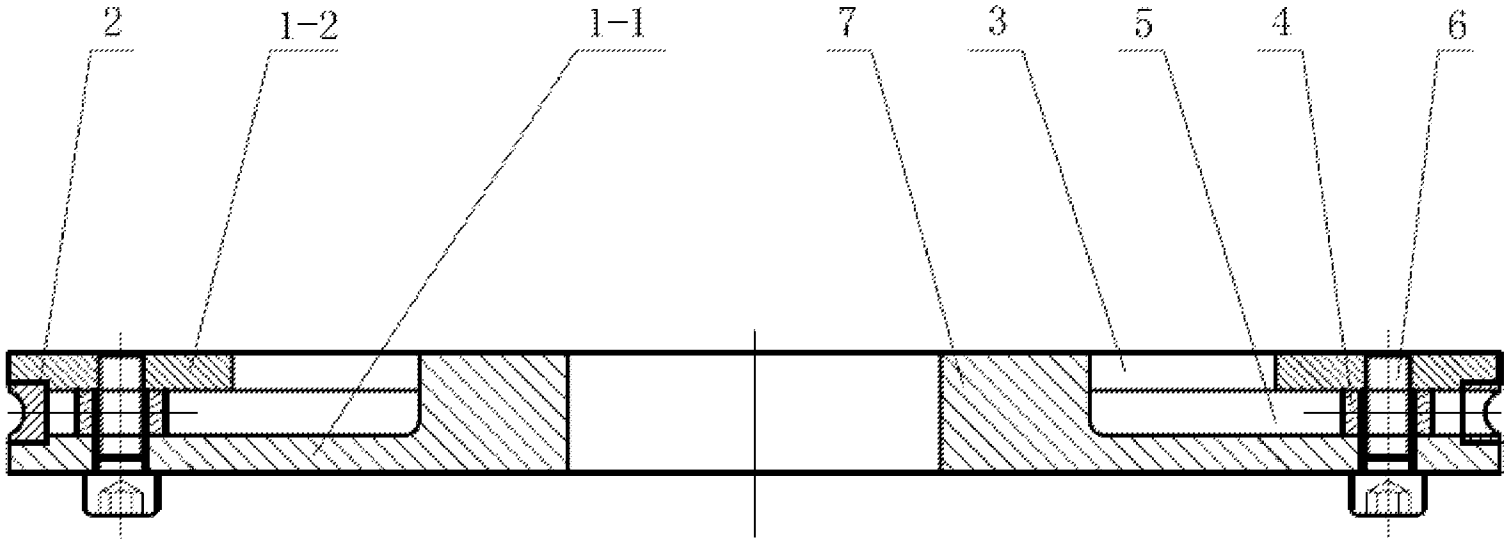
FIG. 3 is a structure diagram of an inner part of FIG. 2.

The base plate 1-1 is a circular plate, a center axle 7 is disposed at an axis position of the base plate 1-1, an axle hole of the center axle 7 and a rotating shaft of the grinding wheel of the grinding machine are assembled together. A diameter of an outer ring of the ring-shaped press plate 1-2 is equal to a diameter of a circle of the base plate 1-1, and a diameter of an inner ring of the ring-shaped press plate 1-2 is larger than an outer diameter of the center axle 7 of the base plate 1-1. The base plate 1-1 and the ring-shaped press plate 1-2 are separated by hollow support columns 4 uniformly distributed along the circumference of the base plate 1-1. Bolts 6 are inserted into the support columns 4 to axially fasten the base plate 1-1 and the ring-shaped press plate 1-2 together. Meanwhile, a grinding ring 2 is clamped and bonded (usually by a glue) between inner end surfaces at circumferential edges of the base plate 1-1 and the ring-shaped press plate 1-2, as shown in FIGS. 1-3.

Taken processing of an arc edge as an example, a grinding surface of the grinding ring 2 is in the shape of an arc and is provided with circular or oval water outlets 2-1 that pass through the grinding ring and are uniformly distributed on the grinding surface. The water outlets 2-1 are a non-entity process region 2-1 of the arc-shaped grinding surface, and remain portions of the arc-shaped grinding surface is an entity processing region 2-2 that contacts with the workpiece 8. The number of the water outlets 2-1 is larger than zero and smaller than 30 within a range of a contact line length between the grinding ring 2 and the workpiece 8 during the grinding of the grinding wheel. Meanwhile, total circumference lengths at different axial positions of the entity processing region 2-2 are corresponding to the depths of the to-be-ground portion at corresponding positions of the workpiece 8, respectively, and the corresponding relation is a proportion relation. In another word, ratios of the total circumference lengths Ln at different axial positions of the entity processing region 2-2 and the depths of the to-be-ground portion Δn at corresponding positions of the workpiece 8 are equivalent (Ln/Δn, L1/Δ1, L2/Δ2, L3/Δ3, are equivalent), thereby forming an equivalent-shaped abrasion structure on the arc-shaped grinding surface. That is, different axial positions of the grinding wheel are allocated with corresponding total circumference lengths of the entity processing region according to the machining allowances that need to be ground by the grinding wheel during the processing process. The larger the depth of the to-be-ground portion of the workpiece is, the larger the corresponding total circumference length of the entity processing region is. The smaller the depth of the to-be-ground portion of the workpiece is, the smaller the corresponding total circumference length of the entity processing region is. The depth of the to-be-ground portion and the corresponding total circumference length at different positions form a proportional constant C, thereby forming the equivalent-shaped abrasion structure and solving or alleviating the deformation problem of special-shaped grinding wheel, as shown in FIGS. 1-2, 4A, and 4B.

Equivalent ratios in the above represent an ideal state. When requirement on the shape of the workpiece is not high, the range thereof is relatively wide, or the manufacturing of the grinding wheel is excessively difficult, a proper difference is permitted between the proportional constant C and the ratios Cn which refers ratios between the total circumference lengths Ln of the entity processing region allocated at different positions in the axial direction of the grinding wheel and the depths of the to-be-ground portion Δn at corresponding positions of the workpiece 8. The amplitude of the difference between the proportional constant C and the ratio Cn satisfies the requirement on an indicator of a specific shape error of the workpiece 8. Furthermore, the shape error occurs in the entity processing region 2-2 because of manufacture error. Thus, a difference between the practical ratio and the theoretical ratio is finally resulted, and the corresponding relation is an approximate proportion relation which is resulted from the shape error of the workpiece 8 and the manufacturing error of the grinding wheel and is conditional approximation. Under the influence of the above factors, variances exist between ratios between the total circumference lengths Ln at different positions in the axial direction and the depths of the to-be-ground portion Δn at corresponding positions of the workpiece 8. The smaller the variance is, the closer the ratio is to the proportional constant C, and the better the effect of the equivalent-shaped abrasion.

Figure 5:
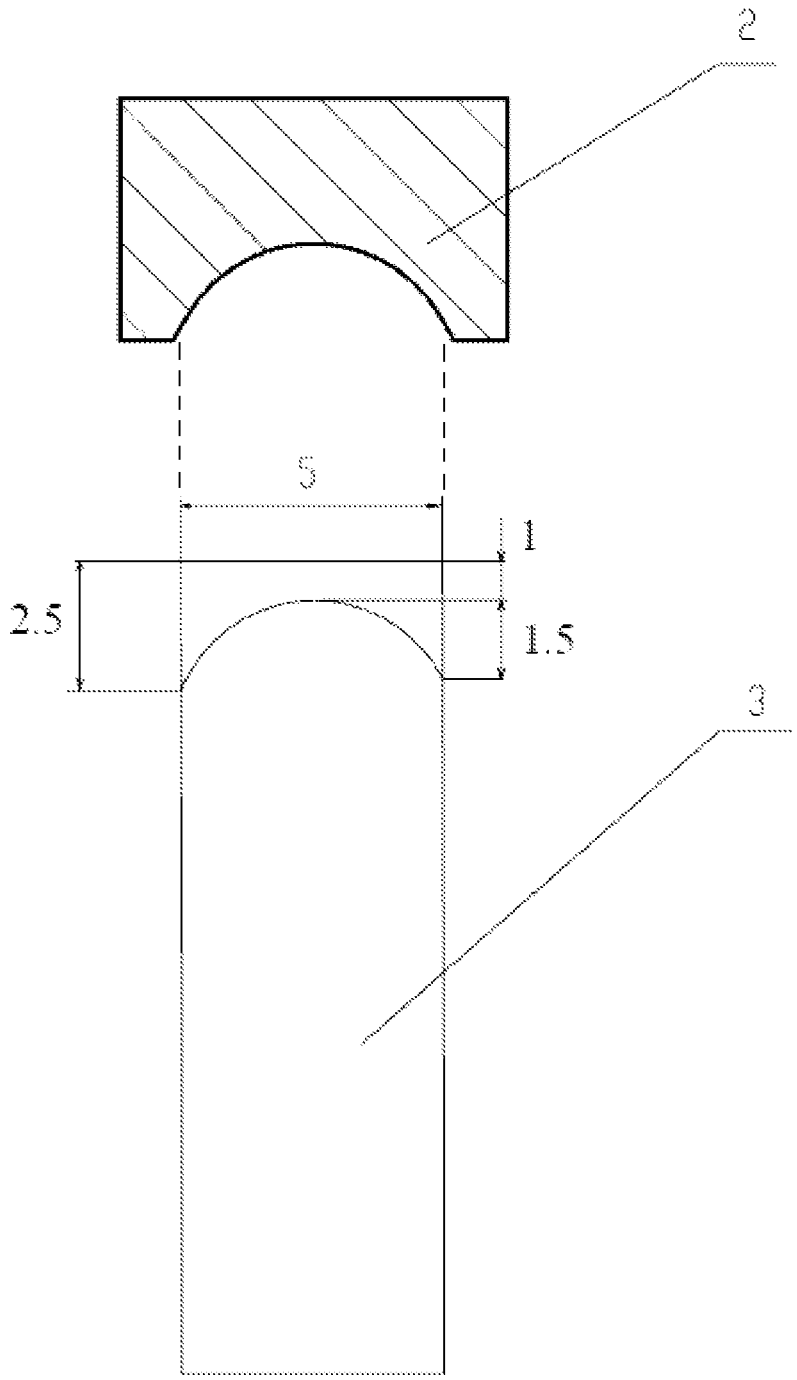
FIG. 5 is a diagram showing a workpiece being machined by a grinding ring.

As shown in FIG. 5, the material of the workpiece 8 has a thickness of 5 mm, an arch rise of the arc of 1.5 mm, a minimum depth of the to-be-ground portion (corresponding to a middle portion in a direction of the thickness) of 1 mm, and a maximum depth of the to-be-ground portion (corresponding to right and left end surfaces) of 2.5 mm. Thus, the proportion relation between the depth of the to-be-ground portion in the axial direction of the workpiece 8 and the total circumference length at corresponding position of the entity processing region 2-2 is: minimum depth of the to-be-ground portion: maximum depth of the to-be-ground portion=1:2.5.

Figure 4A:
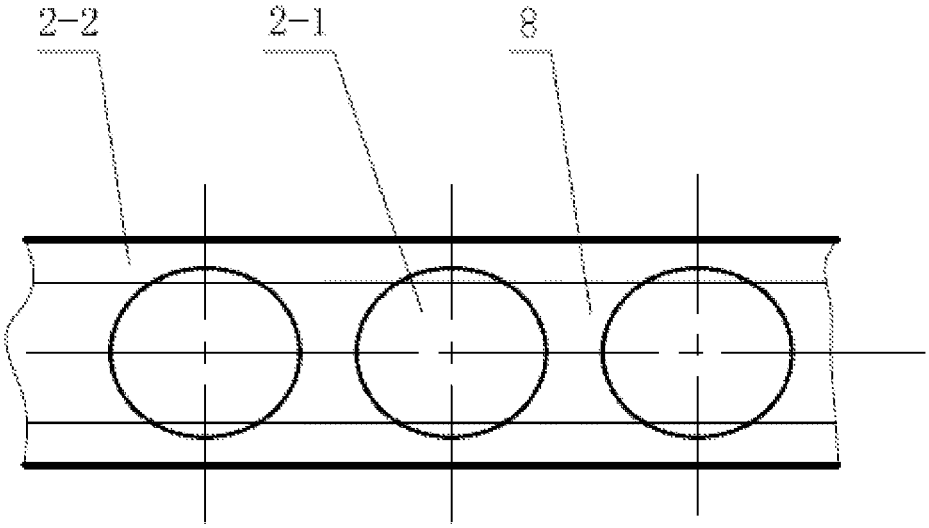
FIG. 4A is a diagram showing distribution of a non-entity processing region on a special-shaped grinding surface of the grinding ring of FIGS. 1-3, in which, an axial width of the non-entity processing region is larger than a thickness of a processing piece.
Figure 4B:
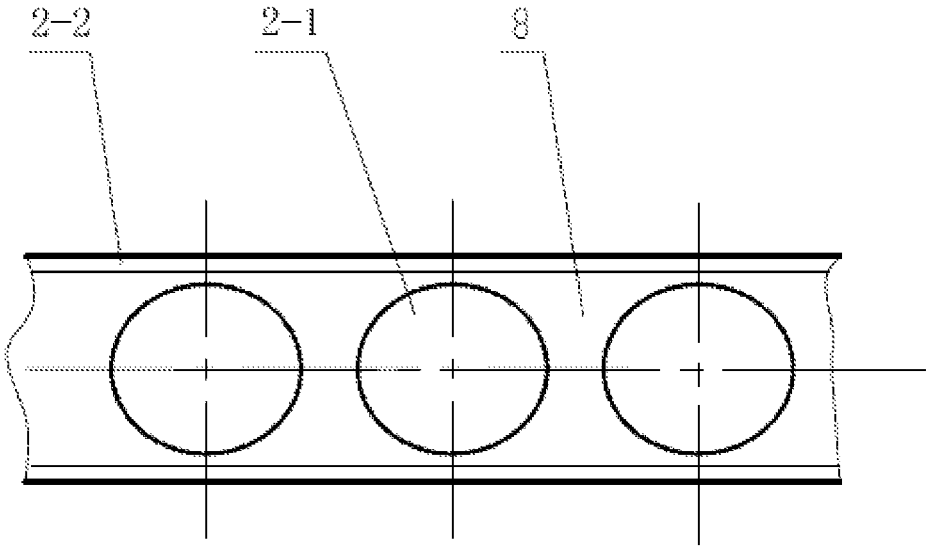
FIG. 4B is a diagram showing distribution of a non-entity processing region on a special-shaped grinding surface of the grinding ring of FIGS. 1-3, in which, an axial width of the non-entity processing region is smaller than a thickness of a processing piece.

As shown in FIG. 4A, when an axial width of the water outlet 2-1 is larger than the thickness of the processing surface of the workpiece 8, a micro-distance discontinuous grinding structure or a semi-discontinuous grinding structure is formed. The semi-discontinuous grinding structure has much smaller beating, thereby being beneficial to process those having high requirement on the edge collapse. When the edge collapse is highly required, the axial width of the water outlet 2-1 is larger than the thickness of the processing surface of the workpiece 8 to form a continuous grinding structure, thereby eliminating the edge collapse resulting from beating, as shown in FIG. 4B.

The grinding wheel of the disclosure has the inner cooling structure and is applicable to an outer cooling grinding machine. The water inlet 3 of the cooling water is a ring-shaped mouth disposed between the ring-shaped press plate 1-2 and the base plate 1-1. A cavity between the base plate 1-1 and the ring-shaped press plate 1-2 is a water storage region 5 for storing the cooling water. The water outlets 2-1 communicate with the water storage region 5, as shown in FIGS. 1 and 3.

When using the grinding wheel to grind the workpiece, a cooling pipe of the outer cooling grinding machine is aligned with the ring-shaped mouth (the water inlet 3) between the center axle 7 of the base plate 1-1 and the ring-shaped press plate 1-2. The cooling water is introduced from the ring-shaped mouth into the water storage region 5 and is stored therein. Under the action of the centrifugal force, the cooling water in the water storage region 5 is discharged on the grinding region via the water outlets 2-1 (the circular or oval through holes), thereby realizing the inner cooling of the workpiece 8. Chips produced in the grinding enter the water outlets 2-1 (the circular or oval through holes) and are contemporarily accommodated therein. When the outlets stored with chips move far from the grinding surface along with the rotation of the grinding wheel, the chips therein are smoothly discharged under the action of the centrifugal force and the water flow.

The grinding wheel of the disclosure is capable of timely and fast discharging the chips from the grinding wheel, thereby ensuring a relatively good exposing height of the abrasive grains, being conducive to improve the grinding performance of the abrasive grains, and improving the sharpness. Meanwhile, because the chips are fast discharged, it is conducive to the action of the cooling water, the grinding heat of the abrasive grains and the frictional heat resulting from the existence of the chips are largely decreased, the working conditions of the abrasive grains are improved, the intensity of the grinding grains is ensured, and the service life of the grinding wheel is prolonged. Furthermore, the decrease of the frictional heat is helpful to improve the surface quality of the workpiece 8.

Special condition: when the grinding surface is complicate and special-shaped, the complicate special-shaped surface is divided into a plurality of sections, and a plurality of corresponding grinding wheels are used, which can be viewed as a superposition of many grinding wheels. When two or more than two grinding wheels are arranged coaxially in parallel for using, water channels (the water storage region 5) of the grinding wheels 1 communicate with one another.

The technical solution of the disclosure is particularly applicable to process rigid metals or non-metal materials. The grinding ring 2 of the grinding wheel is made of a superhard abrasive. The entity processing region 2-2 of the grinding ring 2 is formed by one-step formation or by combining formation.

Figure 6:
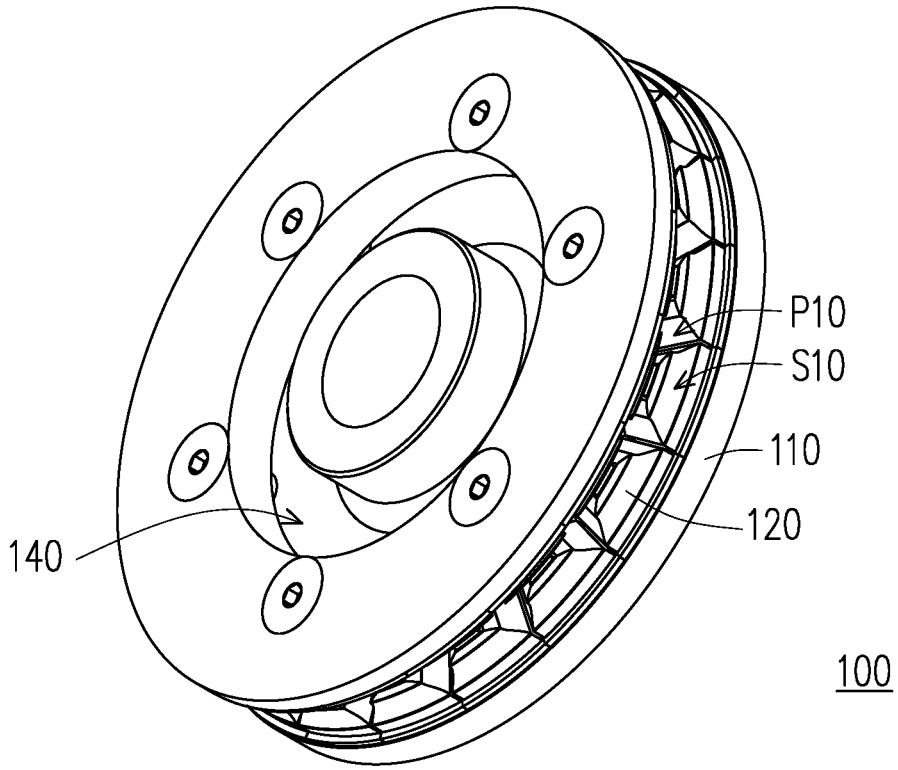
FIG. 6 is a stereogram of another embodiment of a grinding wheel of the invention.
Figure 7:
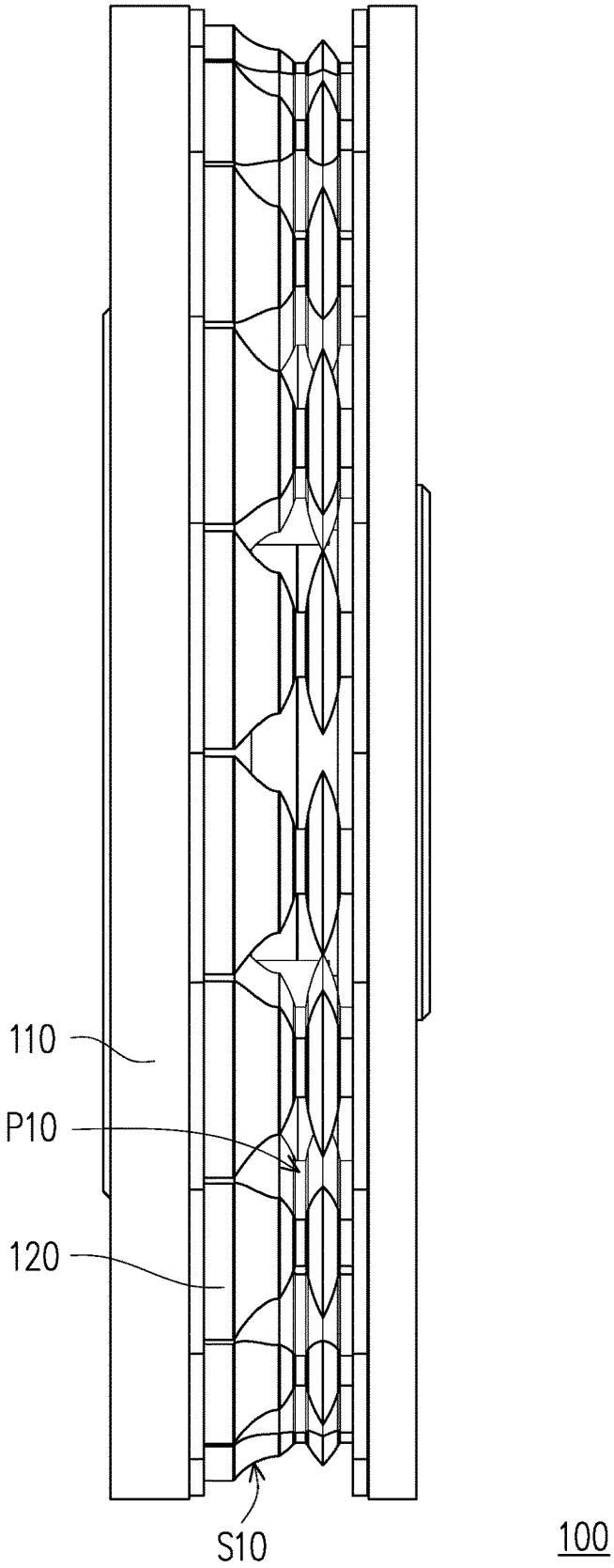
FIG. 7 is a side view of FIG. 6.
Figure 8:
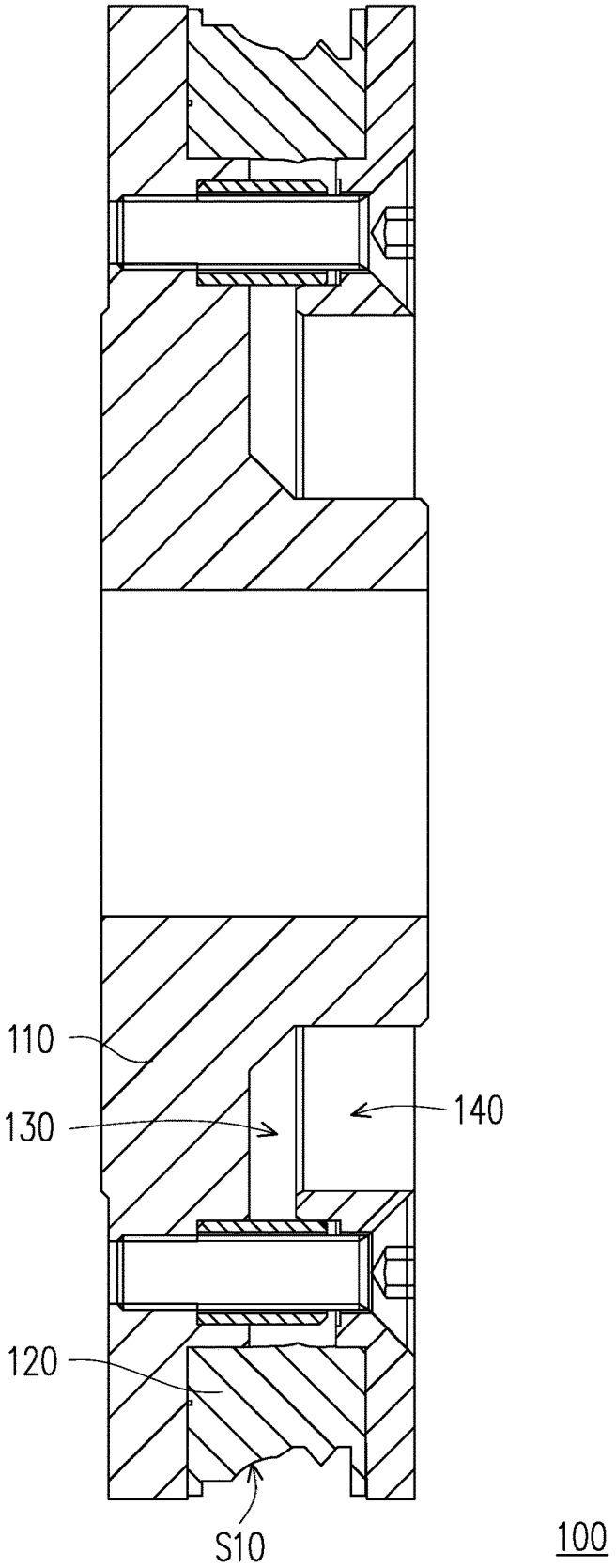
FIG. 8 is a cross-sectional view of FIG. 6.

Please refer to FIGS. 6 to 8, a grinding wheel 100 applied in a manufacturing method for the grinding wheel of an embodiment of the invention is shown. The grinding wheel 100 has structure similar to that of the grinding wheel shown in FIG. 1. The grinding wheel 100 comprises a base 110 and a grinding ring 120 disposed on the base 110. The grinding ring 120 has a grinding surface S10. Water outlets P10 are provided separately at the grinding surface S10. The water outlets P10 pass through the grinding ring 120. That is, the water outlets P10 have openings at the grinding surface S10. The water outlets P10 each communicates with a corresponding water channel 130 provided in the base 110. The water channels 130 are connected to a water inlet 140.

When using the grinding wheel 100 to grind the workpiece, a cooling pipe of the grinding machine is connected to the water inlet 140. The cooling water is introduced from the water inlet 140. Under the action of the centrifugal force, the cooling water is discharged out of the grinding ring 120 via the water outlets P10, thereby realizing the cooling of the workpiece. Chips produced in the grinding enter the water outlets P10 and are contemporarily accommodated therein. When the water outlets P10 stored with chips move far from the workpiece along with the rotation of the grinding wheel 100, the chips therein are smoothly discharged under the action of the centrifugal force and the water flow.

Please refer to FIGS. 9A to 11, in the manufacturing method for the grinding wheel 100, a shape of a first cross-section C10 of a to-be-ground portion 210 of a workpiece 200 to be ground by the grinding wheel 100 should be obtained first. That is, each of the grinding wheel 100 is manufactured for a workpiece 200 having a specific to-be-ground portion 210. The workpiece 200 is a plate vertically disposed under the grinding wheel 100 and vertical to a rotation axis A10 of the grinding wheel 100. The first cross-section C10 has a top line C10A of the plate and the left and right edge lines C10B and C10C of the plate and the profile line C10D ground by the grinding wheel 100 in the bottom. Once the shape of a first cross-section C10 of a to-be-ground portion 210 of a workpiece 200 is changed, the grinding wheel 100 should be re-manufactured. The first cross-section C10 and a rotation axis A10 of the grinding wheel 100 are coplanar. That is, the first cross-section C10 is obtained by intersecting the to-be-ground portion 210 with a plane that contains the rotation axis A10 of the grinding wheel 100. Further, the first cross-section C10 is obtained by intersecting the to-be-ground portion 210 with a vertical surface that passes through the rotation axis A10 of the grinding wheel 100, wherein the vertical surface is perpendicular to the horizontal.

Figure 9A:
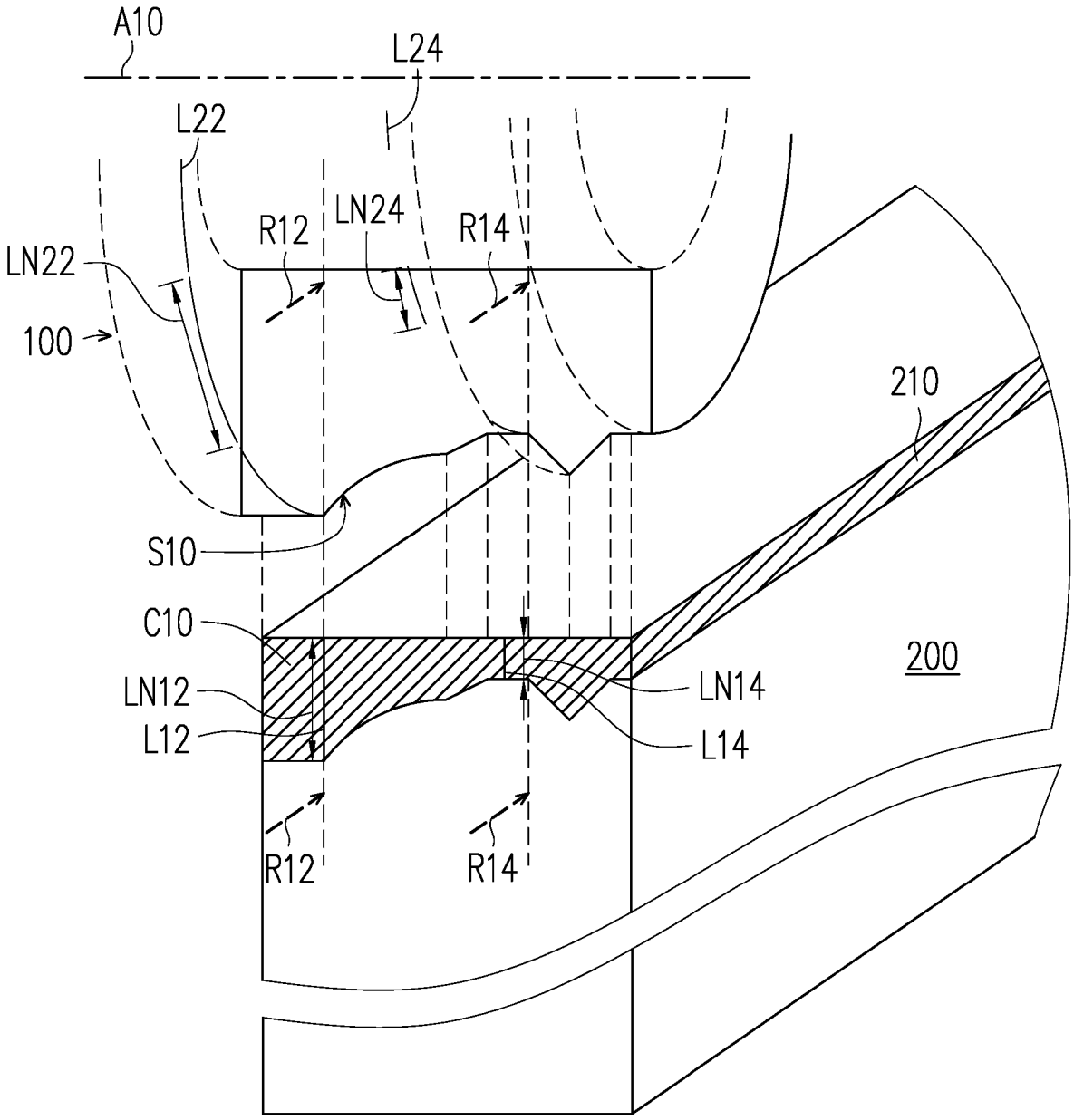
FIG. 9A is a diagram showing a relationship between the workpiece and the grinding ring of FIG. 6.
Figure 9B:
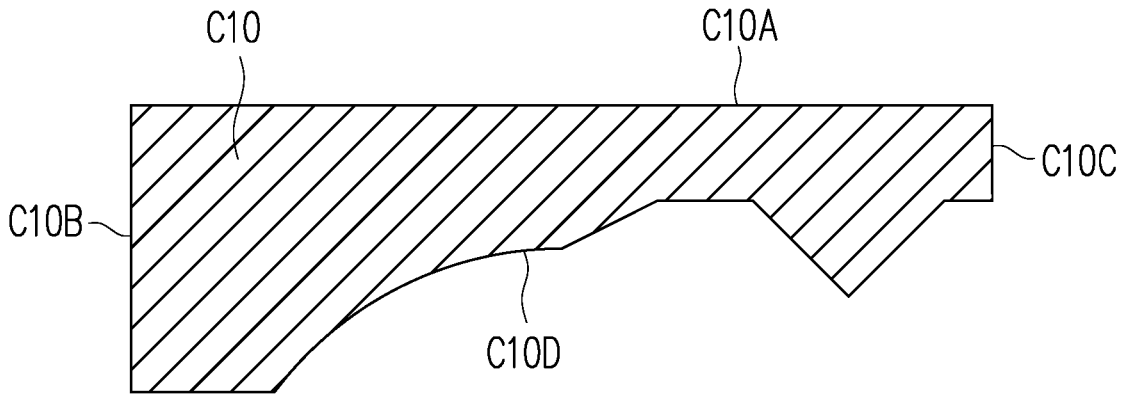
FIG. 9B is a diagram showing the first cross-section.

The grinding surface S10 of grinding wheel 100 is manufactured according the shape of the first cross-section C10 of the to-be-ground portion 210. The grinding surface S10 is substantial the same as a surface formed by the profile line C10D of the first cross-section C10 revolving around the rotation axis A10. The grinding surface S10 is configured to contact and grind the to-be-ground portion 210. When the to-be-ground portion 210 is contacted and to be ground by the grinding surface S10, the grinding wheel 100 and the workpiece 200 are located as shown in FIG. 9. For convenience of explanation, the grinding surface S10 is moved upward to be away from the to-be-ground portion 210 in FIG. 9. In fact, the to-be-ground portion 210 contacts the grinding surface S10. A first intersection line L12 is formed by the first cross-section C10 and a reference plane R12, the first intersection line L12 has a first length LN12. The reference planes (includes reference planes R12 and R14) are perpendicular to the rotation axis A10 of the grinding wheel 100. The reference planes are imaginary planes, so that there can be a plurality of reference planes. Each reference plane will have an intersection line with the first cross-section C10, and each first intersection line may have different length. For example, another first intersection line L14 is formed by the first cross-section C10 and a reference plane R14, the first intersection line L14 has a first length LN14.

Second intersection lines L22 are formed by intersecting the grinding surface S10 and the reference plane R12. Because the water outlets P10 are provided at the grinding surface S10, the second intersection lines L22 are separated into a plurality segments by the water outlets P10, and each second intersection line L22 has a second length LN22. Similar to the first intersection line, each reference plane will have second intersection lines with the grinding surface S10, and each second intersection line may have different length. For example, second intersection line L24 are formed by intersecting the grinding surface S10 and the reference plane R14, the second intersection lines L24 are separated into a plurality segments by the water outlets P10, and each second intersection line L24 has a second length LN24.

Figure 10:
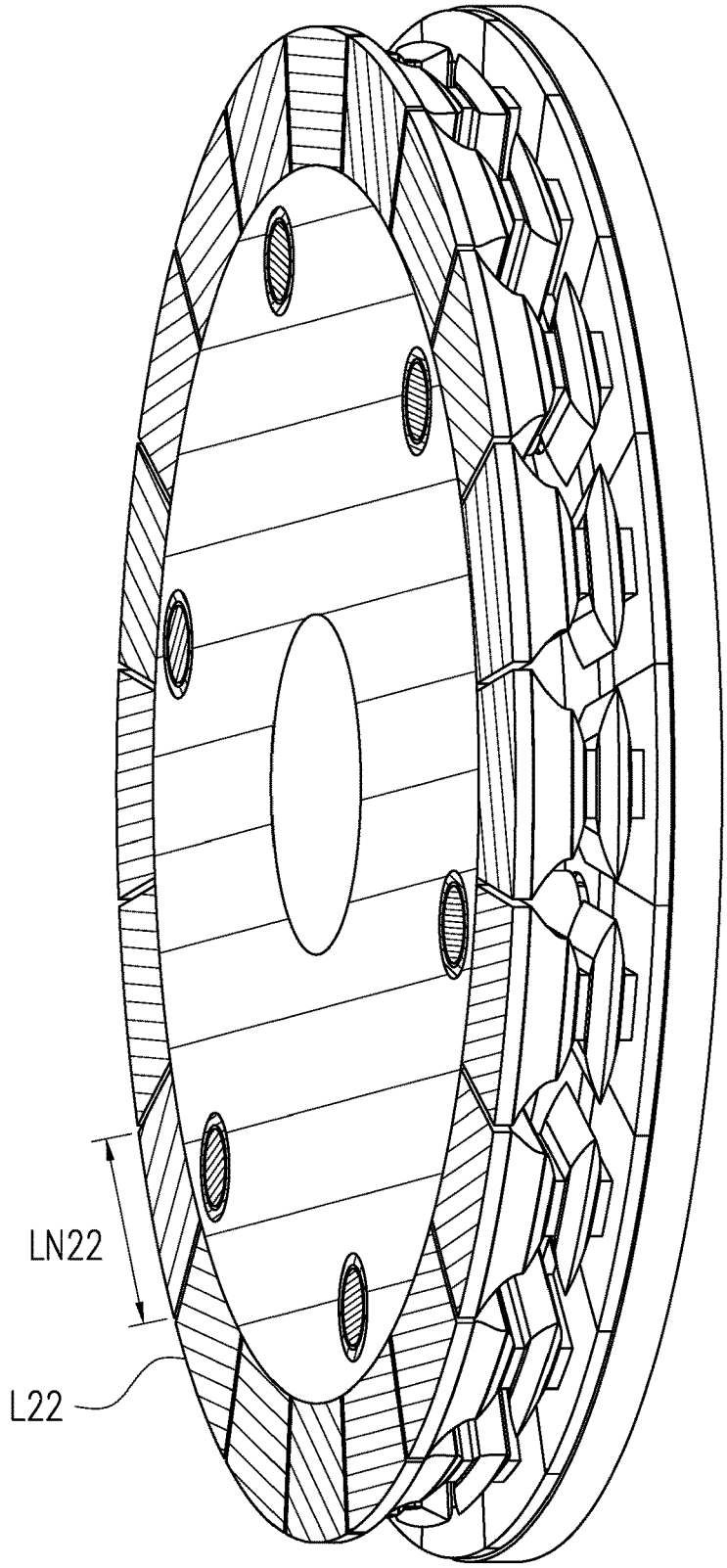
FIGS. 10 and 11 are perspective cross-sectional views of FIG. 6.
Figure 11:
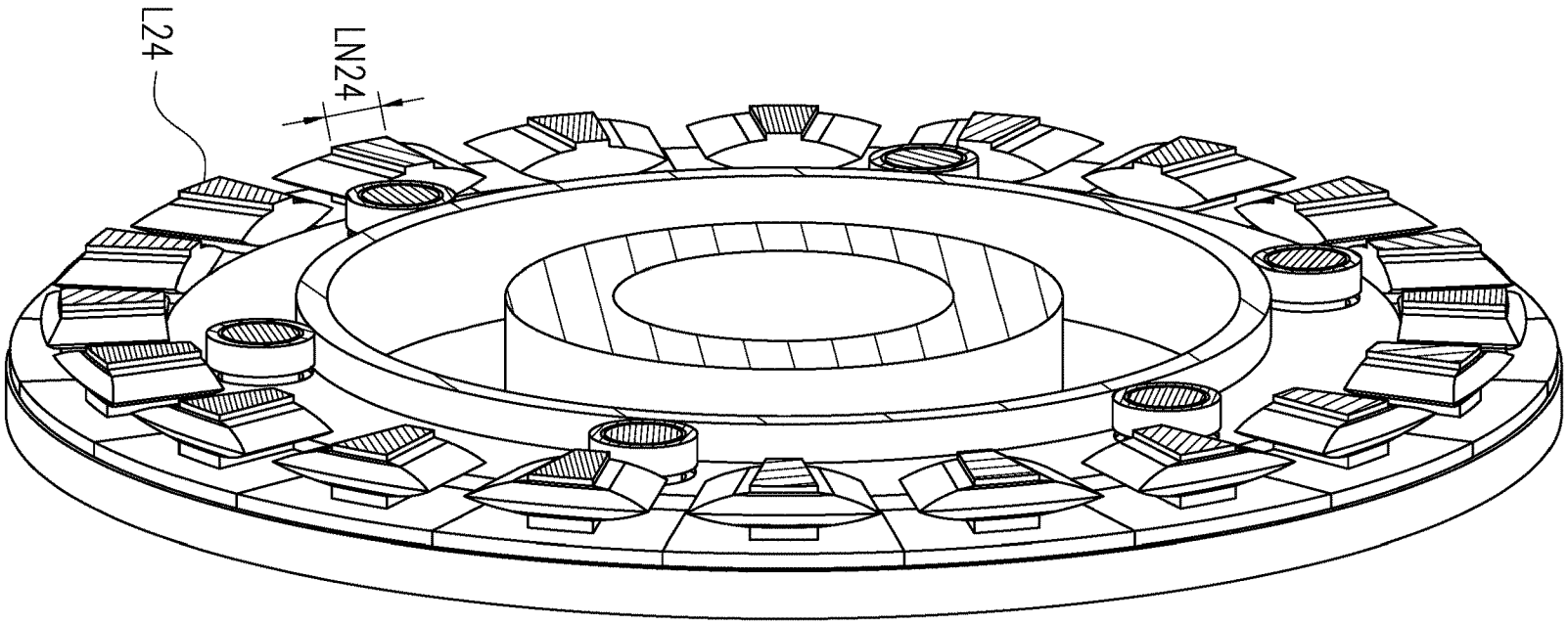

As shown in FIG. 10, for the reference plane R12, a ratio RA12 between the first length LN12 of the first intersection line L12 and a sum of the second lengths LN22 of the second intersection lines L22 can be obtained. As shown in FIG. 11, for the reference plane R14, a ratio RA14 between the first length LN14 of the first intersection line L14 and a sum of the second lengths LN24 of the second intersection lines L24 can be obtained. Since there are a plurality of reference planes (includes reference planes R12 and R14), a plurality of ratios (includes ratios RA12 and RA14) can be obtained. In the present embodiment, the grinding wheel 100 is manufactured to achieved that all ratios (includes ratios RA12 and RA14) should be equal to each other.

For example, since the first length LN12 is longer than the first length LN14, the sum of the second lengths LN22 of the second intersection lines L22 should be longer than the sum of the second lengths LN24 of the second intersection lines L24. By this way, although the first lengths are different for the first intersection line at the different locations, the shape of the grinding surface S10 can be kept, and the deformation problem of the grinding surface S10 can be solved or alleviated. For this aim, when the shape of the first cross-section C10 of the to-be-ground portion 210 is irregular, the shape of the water outlets P10 may be irregular for adjusting the sum of the second lengths of the second intersection lines accordingly to keep high anti-deformation ability of the grinding wheel and decrease deformation factors and mal-function factors, so that the grinding wheel 100 can be prevented from being scrapped due to deformation, and the grinding surface profile duration of the grinding wheel will last much longer than that of the conventional grinding wheel, that means the life of the grinding wheel is longer.

A grinding method of an embodiment of the invention for grinding a workpiece using a grinding wheel is provided accordingly. The workpiece 200 and the grinding wheel 100 are provided first. And then, the workpiece 200 is ground to remove the to-be-ground portion 210 by using the grinding wheel 100.

In the method of the embodiment of the invention, the grinding wheel is manufactured according to the obtained shape of the first cross-section of the to-be-ground portion of the workpiece to be ground by the grinding wheel. The grinding ring has various radius along the axis of the grinding wheel. That is, the grinding surface of the grinding ring is undulating along the axis of the grinding wheel. The method of the embodiment of the invention is not only used for edge circular processing but also used for reshaping the profiles of the workpiece. Therefore, it is important to restrain the grinding wheel from deformation. The grinding wheel applied in the method is customized, so that the appearance of the grinding ring and the shapes and the amount of the water outlets are determined according to the obtained shape of the first cross-section. In the method of the embodiment of the invention, due all ratios between the first length of the first intersection line and a sum of the second lengths of the second intersection lines formed by the same reference plane are equal to each other, the shape of the grinding surface of the grinding ring can be kept from deformation during the grinding process.

FIGS. 12A to 12D are diagrams showing relationships between different workpieces and grinding wheels.

Figure 12A:
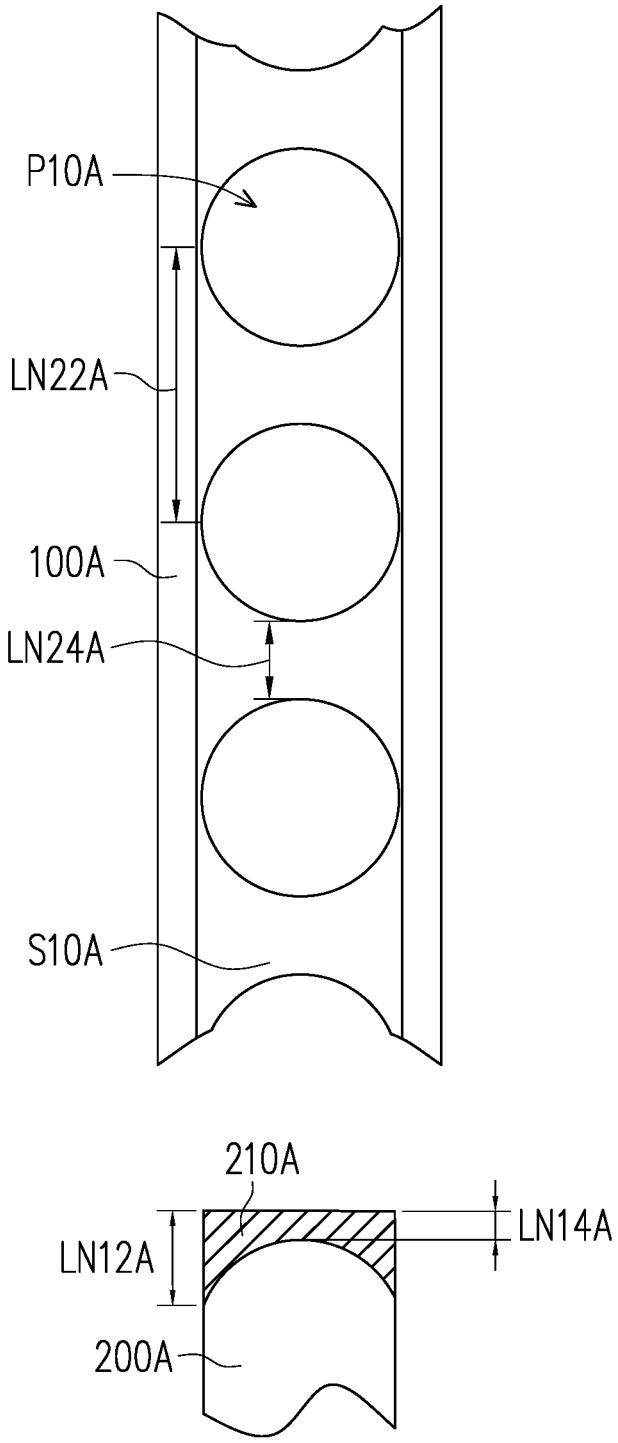
FIGS. 12A to 12D are diagrams showing relationships between different workpieces and grinding wheels.

As shown in FIG. 12A, the first length LN12A of the longest first intersection line of the first cross-section of the to-be-ground portion 210A of the workpiece 200A is 2.5, and the first length LN14A of the shortest first intersection line of the first cross-section of the to-be-ground portion 210A of the workpiece 200A is 1.0. Since the water outlets P10A are regularly distributed at the grinding surface S10A, each of the second lengths LN22A of the second intersection lines corresponding to the longest first intersection line is equal to each other, and each of the second lengths LN24A of the second intersection lines corresponding to the shortest first intersection line is equal to each other. In order to make all ratios between the first length of the first intersection line and a sum of the second lengths of the second intersection lines formed by the same reference plane are equal to each other, the ratio between a sum of the second length LN22A of the longest second intersection line of the grinding surface S10A of the grinding wheel 100A and a sum of the second length LN24A of the shortest second intersection line of the grinding surface S10A of the grinding wheel 100A should be 2.5:1.0.

Figure 12B:
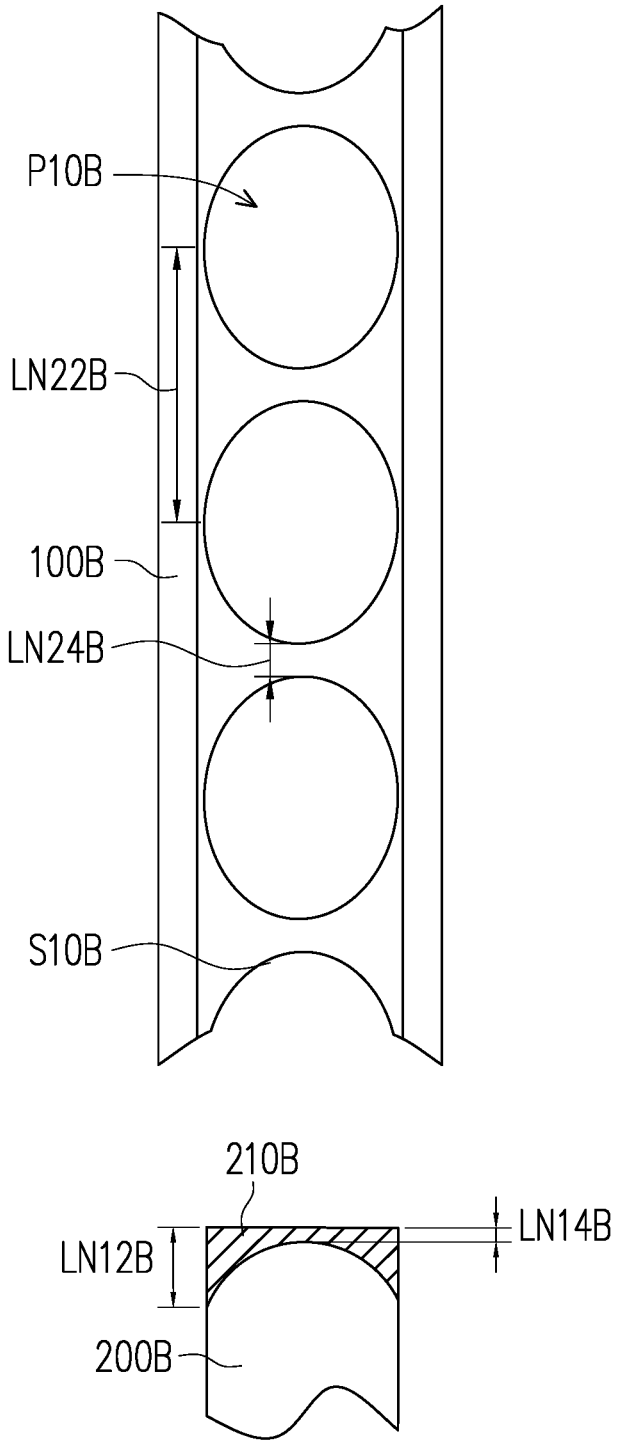

As shown in FIG. 12B, the first length LN12B of the longest first intersection line of the first cross-section of the to-be-ground portion 210B of the workpiece 200B is 2.0, and the first length LN14B of the shortest first intersection line of the first cross-section of the to-be-ground portion 210B of the workpiece 200B is 0.5. Since the water outlets P10B are regularly distributed at the grinding surface S10B, each of the second lengths LN22B of the second intersection lines corresponding to the longest first intersection line is equal to each other, and each of the second lengths LN24B of the second intersection lines corresponding to the shortest first intersection line is equal to each other. In order to make all ratios between the first length of the first intersection line and a sum of the second lengths of the second intersection lines formed by the same reference plane are equal to each other, the ratio between a sum of the second length LN22B of the longest second intersection line of the grinding surface S10B of the grinding wheel 100B and a sum of the second length LN24B of the shortest second intersection line of the grinding surface S10B of the grinding wheel 100B should be 2.0:0.5.

Figure 12C:
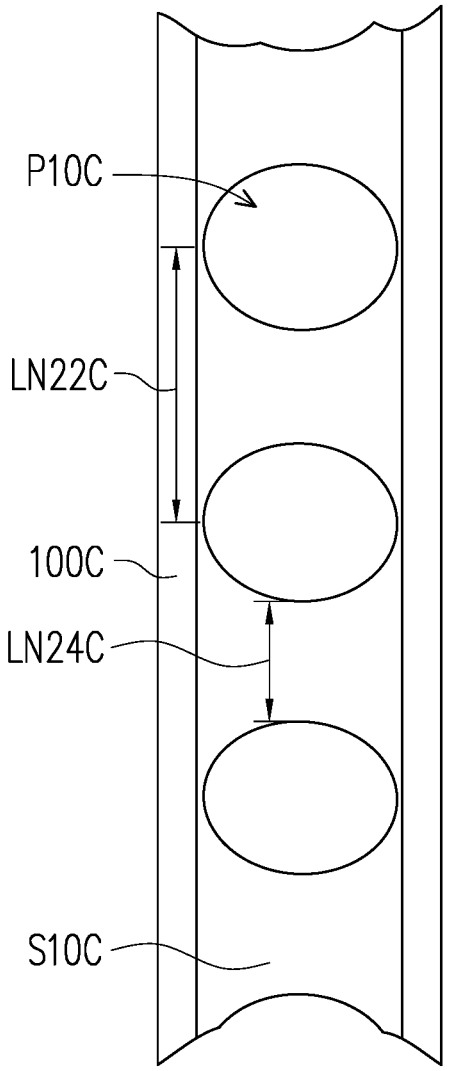
Figure 12C:
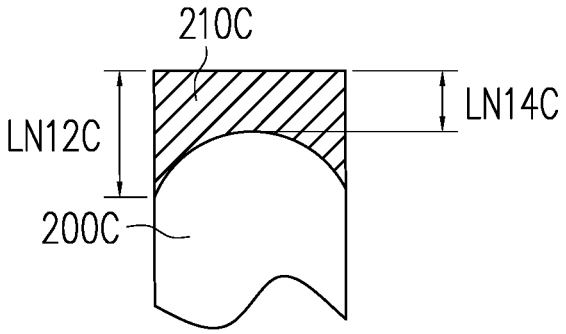

As shown in FIG. 12C, the first length LN12C of the longest first intersection line of the first cross-section of the to-be-ground portion 210C of the workpiece 200C is 3.0, and the first length LN14C of the shortest first intersection line of the first cross-section of the to-be-ground portion 210C of the workpiece 200C is 1.5. Since the water outlets P10C are regularly distributed at the grinding surface S10C, each of the second lengths LN22C of the second intersection lines corresponding to the longest first intersection line is equal to each other, and each of the second lengths LN24C of the second intersection lines corresponding to the shortest first intersection line is equal to each other. In order to make all ratios between the first length of the first intersection line and a sum of the second lengths of the second intersection lines formed by the same reference plane are equal to each other, the ratio between a sum of the second length LN22C of the longest second intersection line of the grinding surface S10C of the grinding wheel 100C and a sum of the second length LN24C of the shortest second intersection line of the grinding surface S10C of the grinding wheel 100C should be 3.0:1.5.

Figure 12D:
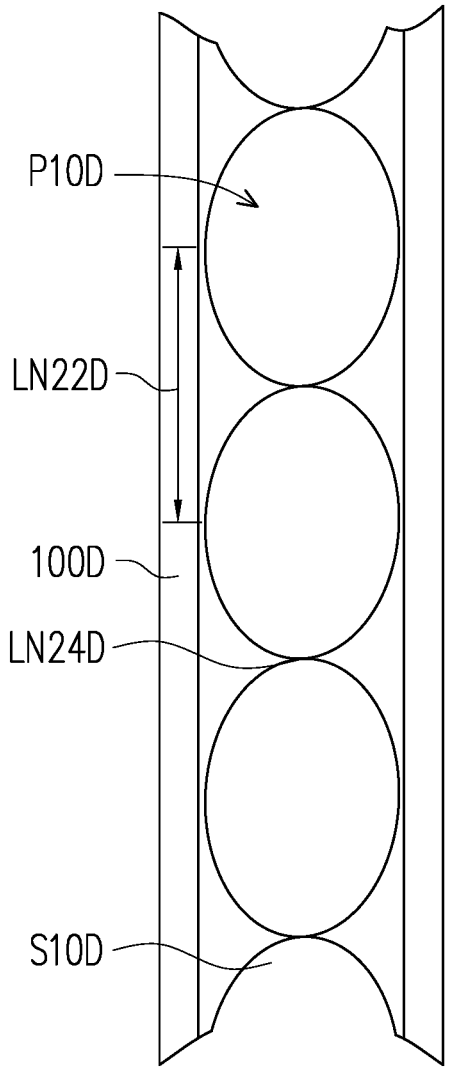
Figure 12D:
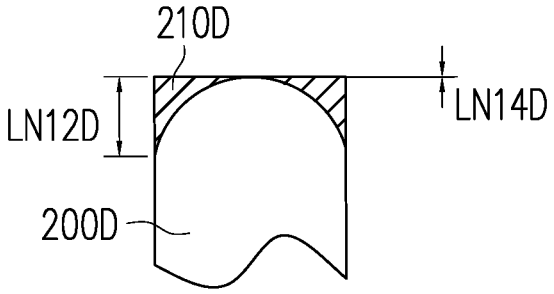

As shown in FIG. 12D, the first length LN12D of the longest first intersection line of the first cross-section of the to-be-ground portion 210D of the workpiece 200D is 2.5, and the first length LN14D of the shortest first intersection line of the first cross-section of the to-be-ground portion 210D of the workpiece 200D is 0. Since the water outlets P10D are regularly distributed at the grinding surface S10D, each of the second lengths LN22D of the second intersection lines corresponding to the longest first intersection line is equal to each other, and each of the second lengths LN24D of the second intersection lines corresponding to the shortest first intersection line is equal to each other. In order to make all ratios between the first length of the first intersection line and a sum of the second lengths of the second intersection lines formed by the same reference plane are equal to each other, the ratio between a sum of the second length LN22D of the longest second intersection line of the grinding surface S10D of the grinding wheel 100D and a sum of the second length LN24D of the shortest second intersection line of the grinding surface S10D of the grinding wheel 100D should be 2.5:0.

Figure 13A:
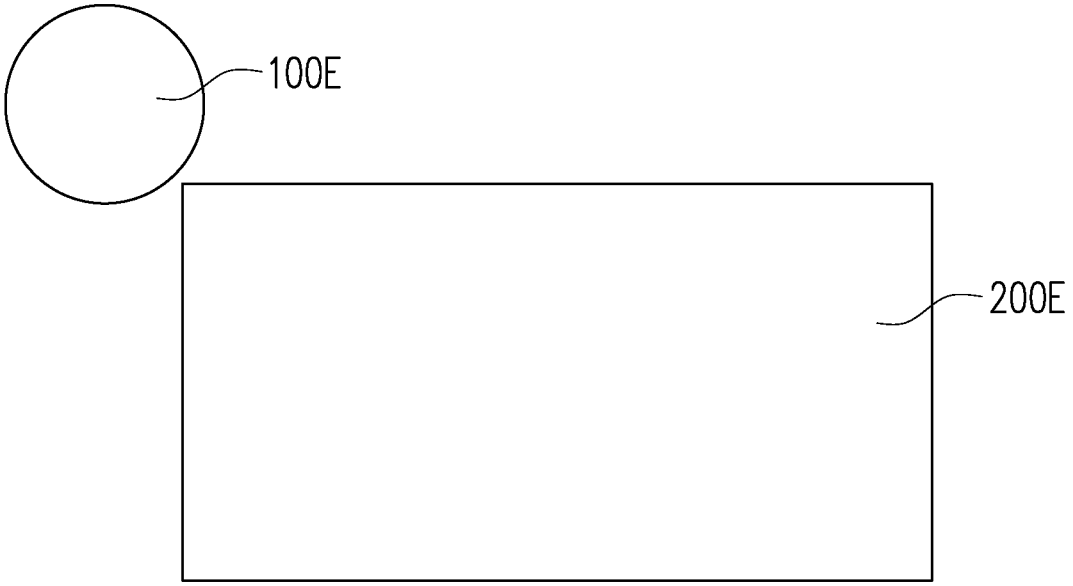
FIG. 13A is a diagram showing the workpiece and the grinding ring are at an initial location.
Figure 13B:
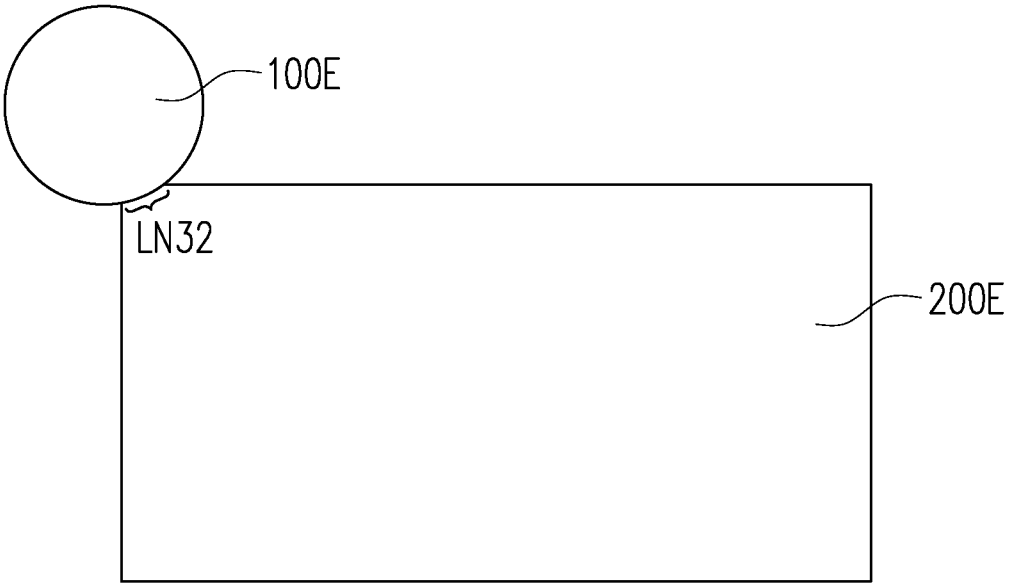
FIG. 13B is a diagram showing the to-be-ground portion is ground.

FIG. 13A is a diagram showing the workpiece and the grinding ring are at an initial location, and FIG. 13B is a diagram showing the to-be-ground portion is ground. As shown in FIG. 13A, the workpiece 200E is not contacted with the grinding ring of the grinding wheel 100E, and the workpiece 200E has not started to be ground. That is, the workpiece 200E and the grinding wheel 100E in FIG. 13A are at an initial location. As shown in FIG. 13B, when the to-be-ground portion of the workpiece 200E is ground, a third intersection line LN32 is formed by one of reference planes perpendicular to the rotation axis of the grinding wheel 100E and a contacting surface between the grinding surface of the grinding wheel 100E and the to-be-ground portion of the workpiece 200E. The number of the water outlets (such as the water outlets P10 shown in the previous embodiments) within the third intersection line LN32 is greater than 0. As shown in above, even though the target profiles of the workpieces are the same, and the shapes and the amount of the water outlets of the grinding rings may different, so as to keep the shape of the grinding surface of the grinding ring during the grinding process.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A manufacturing method for a grinding wheel, comprising:

obtaining a shape of a first cross-section of a to-be-ground portion of a workpiece to be ground by the grinding wheel, wherein the first cross-section and a rotation axis of the grinding wheel are on a same plane perpendicular to the horizontal;

manufacturing the grinding wheel according to the shape of the first cross-section of the to-be-ground portion, wherein the grinding wheel comprises a base and a grinding ring disposed on the base, the grinding ring has a grinding surface configured to contact and grind the to-be-ground portion, the grinding wheel further comprising water outlets provided at the grinding surface, the water outlets passing through the grinding ring, wherein each of the water outlets communicate with a corresponding water channel provided in the base, the water channels being connected to a water inlet, wherein, there are a plurality of reference planes perpendicular to the rotation axis of the grinding wheel, when the to-be-ground portion is ground, a first intersection line formed by the first cross-section along each of the reference planes has a first length, a plurality of second intersection lines formed along the grinding surface and each of the reference planes are separated by the water outlets, each of the second intersection lines has a second length, wherein, for each of the reference planes, there is a ratio between the first length of the first intersection line and a sum of the second lengths of the second intersection lines, the ratios for the reference planes are equal to each other.

2. The manufacturing method of claim 1, wherein a third intersection line is formed by one of reference planes and a contacting surface between the grinding surface and the to-be-ground portion, and the number of the water outlets within the third intersection line is greater than 0.

3. The manufacturing method of claim 1, wherein the shapes of the water outlets are determined, and wherein, when the ratios are not equal each other, at least one of shapes of the outlets is modified to make the ratios for the reference planes are equal to each other.

4. The manufacturing method of claim 1, wherein the base comprises two base plates, wherein the grinding ring is clamped between the two base plates, the water channel is formed between the two base plates, the water inlet is provided at one of the two base plates, and a center axle is provided at the other one of the two base plates.

5. The manufacturing method of claim 1, wherein whole of the grinding ring is formed from a homogeneous material.

6. A grinding method for grinding a workpiece using a grinding wheel, comprising:

providing the workpiece and obtaining a shape of a first cross-section of a to-be-ground portion of the workpiece, wherein the first cross-section and a rotation axis of the grinding wheel are on a same plane perpendicular to the horizontal;

providing the grinding wheel, wherein the grinding wheel is manufactured according the shape of the first cross-section of the to-be-ground portion, the grinding wheel comprising a base and a grinding ring disposed on the base, the grinding ring further comprising a grinding surface configured to contact and grind the to-be-ground portion, and water outlets are provided at the grinding surface, wherein the water outlets pass through the grinding ring, each of the water outlets each communicating with a corresponding water channel provided in the base, the water channels being connected to a water inlet; and grinding the workpiece to remove the to-be-ground portion by using the grinding wheel, wherein, there are a plurality of reference planes perpendicular to the rotation axis of the grinding wheel, when the to-be-ground portion is ground, a first intersection line formed by the first cross-section along each of the reference planes has a first length, a plurality of second intersection lines formed along the grinding surface and each of the reference planes are separated by the water outlets, each of the second intersection lines has a second length, wherein, for each of the reference planes, there is a ratio between the first length of the first intersection line and a sum of the second lengths of the second intersection lines, the ratios for the reference planes are equal to each other.

7. The grinding method of claim 6, wherein a third intersection line is formed by one of reference planes and a contacting surface between the grinding surface and the to-be-ground portion, and the number of the water outlets within the third intersection line is greater than 0.

8. The grinding method of claim 6, wherein the shapes of the water outlets are determined, and wherein, when the ratios are not equal each other, at least one of shapes of the outlets is modified to make the ratios for the reference planes are equal to each other.

9. The grinding method of claim 6, wherein the base comprises two base plates, wherein the grinding ring is clamped between the two base plates, the water channel is formed between the two base plates, the water inlet is provided at one of the two base plates, and a center axle is provided at the other one of the two base plates.

10. The grinding method of claim 6, wherein the material of the whole of the grinding ring is homogeneous.

* * * * *